US010436169B2

(12) United States Patent
Hartmann et al.

(10) Patent No.: US 10,436,169 B2
(45) Date of Patent: Oct. 8, 2019

(54) METHOD AND DEVICE FOR START-STOP SYSTEMS OF INTERNAL COMBUSTION ENGINES IN MOTOR VEHICLES

(75) Inventors: Sven Hartmann, Stuttgart (DE); Juergen Gross, Stuttgart (DE); Stefan Tumback, Stuttgart (DE)

(73) Assignee: SEG Automotive Germany GmbH, Stuttgart (DE)

( * ) Notice: Subject to any disclaimer, the term of this patent is extended or adjusted under 35 U.S.C. 154(b) by 1649 days.

(21) Appl. No.: 13/140,948

(22) PCT Filed: Oct. 21, 2009

(86) PCT No.: PCT/EP2009/063763

§ 371 (c)(1),
(2), (4) Date: Sep. 7, 2011

(87) PCT Pub. No.: WO2010/069646

PCT Pub. Date: Jun. 24, 2010

(65) Prior Publication Data

US 2011/0308490 A1 Dec. 22, 2011

(30) Foreign Application Priority Data

Dec. 19, 2008 (DE) ..... 10 2008 054 979

(51) Int. Cl.
*F02N 11/08* (2006.01)
*F02N 15/06* (2006.01)
(Continued)

(52) U.S. Cl.
CPC ..... *F02N 15/063* (2013.01); *F02N 11/0855* (2013.01); *F02N 11/0814* (2013.01);
(Continued)

(58) Field of Classification Search
CPC ..... F02N 11/0814; F02N 11/0851; F02N 11/0855; F02N 15/022; F02N 15/04;
(Continued)

(56) References Cited

U.S. PATENT DOCUMENTS 1,638,248 A * 8/1927 Elsey ..... 74/6
1,753,591 A * 4/1930 Bertsche, Jr. ..... 74/6
(Continued)

FOREIGN PATENT DOCUMENTS

DE 19721568 A1 12/1997
DE 102005057532 A1 * 7/2006 ..... F02N 15/06
(Continued)

OTHER PUBLICATIONS

PCT/EP2009/063763 International Search Report.

*Primary Examiner* — John M Zaleskas
(74) *Attorney, Agent, or Firm* — Michael Best & Friedrich LLP

(57) ABSTRACT

The invention relates to a starting method for internal combustion engines in motor vehicles, comprising a start-stop system, and to a starting device (10) for carrying out said method, said starting device comprising a starter motor (11) and an insertion device (12, 20) which axially inserts a slip-on pinion (13) into a crown gear (14) of the internal combustion engine when a stop cycle begins. In order to minimize the period until the engine can be restarted, the pinion (13) is resiliently inserted into the still rotating crown gear (14) by means of a pressure spring (25) when the stop phase begins, once the internal combustion engine (15) is switched off but before it comes to a standstill and with the starter motor (11) switched off.

18 Claims, 3 Drawing Sheets

(51) Int. Cl.
*F02N 15/02* (2006.01)
*F02N 19/00* (2010.01)

(52) U.S. Cl.
CPC ..... *F02N 15/022* (2013.01); *F02N 15/067* (2013.01); *F02N 19/005* (2013.01); *F02N 2019/008* (2013.01)

(58) Field of Classification Search
CPC ..... F02N 15/06; F02N 15/062; F02N 15/063; F02N 15/065; F02N 15/066; F02N 15/067; F02N 15/068; F02N 2019/008; F02N 19/005
USPC .... 123/179.25, 179.3, 179.4; 74/6, 7 A, 7 C, 74/7 R, 457; 290/38 R, 38 B, 38 C, 38 E
See application file for complete search history.

(56) References Cited

U.S. PATENT DOCUMENTS

| | | | | | |
|---|---|---|---|---|---|
| RE17,858 | E | * | 11/1930 | Dorsey et al. | 74/6 |
| 1,870,366 | A | * | 8/1932 | Kearney | 74/6 |
| 1,883,432 | A | * | 10/1932 | Whitney | 74/6 |
| 1,889,995 | A | * | 12/1932 | Meeder | 74/7 R |
| 2,117,230 | A | * | 5/1938 | Thornburg et al. | 123/179.3 |
| 2,839,935 | A | * | 6/1958 | Hartzell et al. | 74/6 |
| 2,871,708 | A | * | 2/1959 | Raver | 74/6 |
| 3,741,021 | A | * | 6/1973 | Parsons | 74/7 R |
| 3,744,467 | A | * | 7/1973 | Wagner | 123/179.3 |
| 3,798,977 | A | * | 3/1974 | Digby | 74/6 |
| 3,915,020 | A | * | 10/1975 | Johnson | 74/6 |
| 4,019,393 | A | * | 4/1977 | Mortensen | 74/6 |
| 4,425,812 | A | * | 1/1984 | Williams | 74/6 |
| 5,251,499 | A | | 10/1993 | Isozumi | |
| 5,402,758 | A | * | 4/1995 | Land et al. | 123/179.3 |
| 5,533,415 | A | * | 7/1996 | Ackermann et al. | 74/7 E |
| 6,763,735 | B2 | * | 7/2004 | Siems et al. | 74/6 |
| 6,851,405 | B2 | * | 2/2005 | Kajino et al. | 123/179.25 |
| 6,880,415 | B2 | | 4/2005 | Nito | |
| 7,665,438 | B2 | * | 2/2010 | Hirning et al. | 123/179.3 |
| 7,814,807 | B2 | | 10/2010 | Hirabayashi | |
| 2002/0017260 | A1 | * | 2/2002 | Saito et al. | 123/179.3 |
| 2004/0134294 | A1 | * | 7/2004 | Hirabayashi et al. | 74/7 R |
| 2004/0250784 | A1 | * | 12/2004 | Kajino et al. | 123/179.25 |
| 2006/0181084 | A1 | * | 8/2006 | Albertson et al. | 290/38 R |
| 2006/0201266 | A1 | * | 9/2006 | Kajino et al. | 74/6 |
| 2007/0137602 | A1 | * | 6/2007 | Kassner | 123/179.25 |
| 2007/0233357 | A1 | * | 10/2007 | Sugai et al. | 701/105 |
| 2008/0053390 | A1 | * | 3/2008 | Rizoulis et al. | 123/179.25 |
| 2008/0127927 | A1 | * | 6/2008 | Hirning et al. | 123/179.3 |
| 2008/0127935 | A1 | * | 6/2008 | Park | 123/332 |
| 2009/0020091 | A1 | * | 1/2009 | Botzenhard et al. | 123/179.3 |
| 2009/0133532 | A1 | * | 5/2009 | Laubender | 74/7 E |
| 2009/0224557 | A1 | * | 9/2009 | Reynolds et al. | 290/38 R |
| 2010/0282199 | A1 | * | 11/2010 | Heyers et al. | 123/179.3 |

FOREIGN PATENT DOCUMENTS

| | | | | |
|---|---|---|---|---|
| EP | 0547632 | A | | 6/1993 |
| EP | 0848159 | A1 | | 6/1998 |
| EP | 1491764 | A2 | | 12/2004 |
| FR | 2878909 | A1 | | 6/2006 |
| GB | 178882 | A | * | 4/1922 |
| GB | 197793 | A | * | 5/1923 |
| GB | 177798 | A | * | 6/1923 |
| GB | 400770 | A | * | 11/1933 |
| GB | 2036876 | A | * | 7/1980 |
| JP | 2000274336 | | | 10/2000 |
| JP | 2001248710 | | | 9/2001 |
| JP | 2002250428 | | | 9/2002 |
| JP | 2003065191 | A | * | 3/2003 |
| JP | 2005002834 | A | * | 1/2005 |
| JP | 2005330813 | A | * | 12/2005 |
| JP | 2006132343 | | | 5/2006 |
| JP | 2006161590 | | | 6/2006 |
| JP | 2009168230 | A | | 7/2009 |
| WO | WO 2006120180 | A2 | * | 11/2006 |
| WO | WO 2007101770 | A1 | * | 9/2007 |
| WO | 2008/131983 | A1 | | 11/2008 |
| WO | 2009/095115 | A1 | | 8/2009 |

* cited by examiner

METHOD AND DEVICE FOR START-STOP SYSTEMS OF INTERNAL COMBUSTION ENGINES IN MOTOR VEHICLES

BACKGROUND OF THE INVENTION

The invention relates to a starting method for internal combustion engines in motor vehicles, with a start-stop system and to a starting device for carrying out the method.

Internal combustion engines of motor vehicles are customarily turned on by means of a starter motor, wherein first of all a pinion of the starting device meshes in a ring gear of the internal combustion engine before the starter motor is switched on. In addition, with a start-stop system in motor vehicles, if the motor vehicle has stopped for a relatively long time, the internal combustion engine is automatically switched off and, at the end of the stop phase, the engine is then started again automatically in order to be able to continue the journey.

It is known from EP 08 48 159 A1 to bring starter pinions into the meshed position right at the beginning of a stop state of the engine in order subsequently, at the beginning of the starting operation, to immediately switch on the starter motor at full power. This significantly reduces the time for the starting operation. However, this solution still has the disadvantage that, for the meshing of the starter pinion at the beginning of the stop phase, it is necessary to wait first until the engine is at a standstill, this meaning, if the stop phases are very short, a delay which may be critical, for example in a traffic jam because of vehicles following too closely.

In order to shorten the meshing operation at the beginning of a stop phase, it has already been proposed using electronic activation of the starter motor to synchronize the rotational speed of the pinion with the rotational speed of the ring gear of the engine, in order thereby for the starter pinion to already be meshed in the still rotating ring gear of the engine. A disadvantage here is that, in order to synchronize the circumferential speed of the ring gear and of the starter pinion, a considerable electronic outlay on control has to be expended, since the circumferential speed of the ring gear changes greatly due to compressions in the engine cylinders when the switched-off internal combustion engine comes to a stop.

SUMMARY OF THE INVENTION

It is endeavored with the present invention to ensure that, at the beginning of a stop operation, the starter pinion meshes in a simple manner in the still rotating ring gear using simple mechanical means after the internal combustion engine is switched off.

In start-stop systems for an internal combustion engine for carrying out the method according to the invention and in a starting device according to the invention, a temporarily shortened starting operation is obtained using simple mechanical means by the starter pinion meshing in the engine ring gear as it comes to a stop. The electronic control of the start-stop system is substantially simplified as a result. Furthermore, this has the effect that, in comparison to an uncushioned meshing of the starter pinion in a still rotating ring gear, no damage occurs due to recoils occurring in the process at the free wheel or planetary gearing of the starter.

Since, in the event of an axial pressure spring system of the starter pinion, meshing in the revolving ring gear takes place only at slow rotations of the ring gear and with the best tooth-to-gap position, in an advantageous development of the invention the effect achieved by a selected spring characteristic of the pressure spring is that the pinion is first of all engaged by a small amount in the ring gear and, in the process, is first of all carried along only via correspondingly small contact surfaces of the teeth of the pinion and ring gear. At low circumferential speeds, the pinion can be meshed completely in the ring gear by the force of the pressure spring. By contrast, the teeth of the starter pinion are pushed out of the ring gear again if the circumferential speed of the ring gear is too great. The starter pinion which now rotates slowly is then optionally repeatedly engaged again to a greater extent into the next gap until the starter pinion is finally completely meshed in the ring gear as the rotational speed increases.

An advantageous development of the invention consists in that, even before the engine is at a standstill, the crankshaft can be rotated by means of the engine control unit from the starter motor into the optimum starting position in order thereby to shorten the time of the subsequent restart.

In a first particularly simple and expedient embodiment for carrying out the starting method, with a starter pinion which can be displaced axially on a pinion shaft, the pressure spring in the form of a helical compression spring is clamped between a shoulder of the pinion shaft and the annular shoulder formed rear side of the pinion, wherein the pinion is accommodated as a slip-on pinion in an axially displaceable manner on the pinion shaft by means of a sliding toothing. In the event of an additional arrangement of a meshing spring which is known per se, the pressure spring advantageously has a smaller spring constant than the meshing spring.

In order to facilitate the meshing of the pinion, the teeth of the pinion and/or of the ring gear are advantageously provided on the front end sides thereof with a beveled portion of the tooth flanks and with a beveled portion on the tooth tip. In this case, the beveled portions are advantageously provided in particular on those tooth flanks of the ring gear which are in front in the direction of rotation of the ring gear and on the rear tooth flanks of the pinion. In addition, the pinion shaft can advantageously be displaced axially by a drive shaft of the starting device, preferably by means of a free wheel via a sliding toothing without a quick-acting screw thread.

In a further embodiment, adjacent teeth of the pinion and of the ring gear, in a development of the invention, each have an axial length which differs by the same amount in the region of the front end sides which are opposite in the demeshed state. In this embodiment, the meshing of the pinion in the ring gear can be shortened even at high rotational speeds by the protruding teeth of the pinion and ring gear now being spaced apart from one another by double the tooth pitch such that, even at high speeds of rotation of the ring gear, the pinion teeth can still penetrate to an adequate depth in the tooth gaps by means of the axial pressure spring in order to be carried along. In the simplest embodiment, every second tooth of the pinion and ring gear is shortened in relation to the pinion width and ring gear width. Expediently, the non-shortened teeth are also provided here on the front end sides thereof with a beveled portion on the tooth tip, which beveled portion is preferably shorter than the tooth projection. In order, even here, to provide the possibility of allowing the starting pinion to first of all slide off the teeth of the ring gear, it is proposed, in a refinement of the invention, to provide beveled portions on those tooth flanks of the projecting teeth of the ring gear which are in front in the direction of rotation of the ring gear and on the rear tooth flanks of the projecting teeth of the pinion.

BRIEF DESCRIPTION OF THE DRAWINGS

Details of the invention are explained in more detail below by way of example with reference to the figures, in which.

DETAILED DESCRIPTION

Figure 1:
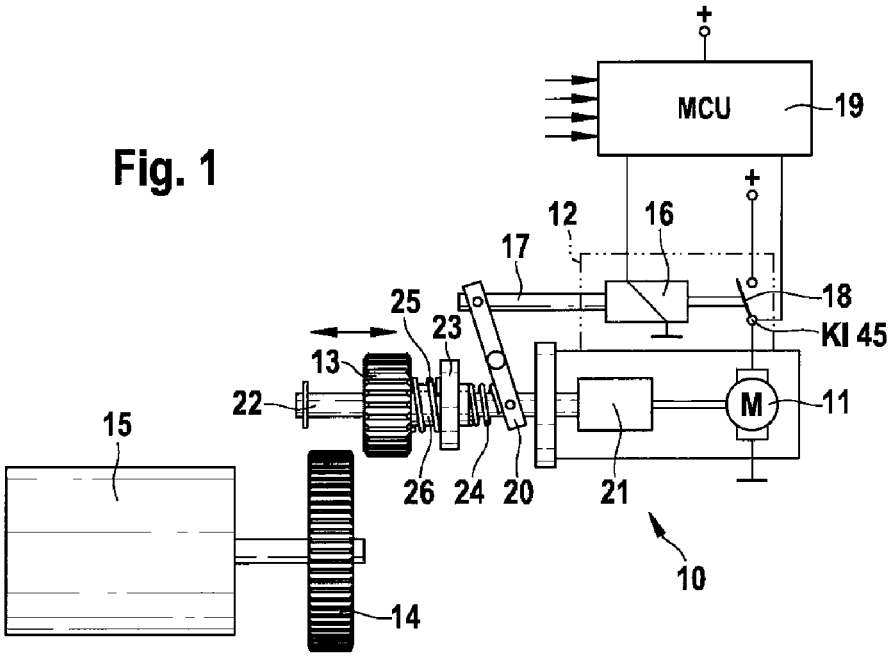
FIG. 1 shows, in a schematic illustration, a start-stop system for motor vehicles with a starting device.

FIG. 1 shows, in a first exemplary embodiment, a schematic illustration of a start-stop system for internal combustion engines in motor vehicles. Said system comprises a starting device 10 with a starter motor 11, a starter relay 12 and a pinion 13 for axial meshing in a ring gear 14 of an internal combustion engine 15. The starter relay 12 has a relay winding 16, a tappet 17 and a switching contact 18 for switching the main current for the starter motor 11. The start-stop system furthermore comprises an engine control unit 19 which, like the switching contact 18 of the starter relay 12, is connected by a positive terminal to the electrical system (not illustrated) of the motor vehicle. The engine control unit 19 is furthermore supplied via a plurality of signal inputs with various sensor signals which are used, for example, to detect clutch actuation, brake actuation, the position of a transmission selector lever, the rotational speed of the engine and of the wheels, and the like. The engine control unit 19 is furthermore connected via an output to the relay winding 16, with which the pinion 13 meshes, via an engagement lever 20, in the ring gear 14 of the internal combustion engine 15, and the starter motor 11 is switched on via the switching contact 18 in order to start the internal combustion engine 15. In this case, the starter motor 11 uses a planetary gearing 21 to drive a drive shaft 22 which, as a rule, is coupled to a free wheel 23 via a quick-acting screw thread. The free wheel 23 is connected integrally on the output side to a pinion shaft to which the pinion 13 is fastened so as to be axially displaceable, limited by stops, by means of a sliding toothing.

During cold starting of the engine 15, first of all the starter relay 12 is activated via the engine control unit 19 by a starting signal triggered by the motor vehicle driver, the starter motor 11 being activated and rotated slightly directly by the engine control unit 19 via a further connection. By means of the relay winding 16, the pinion 13 is also advanced via the tappet 17 and the engagement lever 20 as far as the ring gear 14 of the engine. In a tooth-to-tooth position, an engagement spring 24 which is inserted between the free wheel 23 and engagement lever 20 is tensioned in a known manner such that, by means of slight rotation of the starter motor 11, the teeth of the pinion 13 can engage in the next tooth gap of the ring gear 14 as far as a stop on the drive shaft 22.

The start-stop system of the motor vehicle is then activated during the driving mode, and, at the beginning of each stop phase of the vehicle, the internal combustion engine is switched off, for example, by the speed of rotation at the front wheels of the vehicle being detected. At the same time, in a first stage for preparing a subsequent restart of the engine, a meshing operation of the pinion 13 in the still moving ring gear 14 of the engine 15 is triggered by a metered excitation current being passed via the engine control unit 19 to the starter relay 12. The pinion 13 is now advanced axially by the engagement lever 20 via the tappet 17 to mesh in the ring gear 14. In order to make the internal combustion engine 15 ready to start again as rapidly as possible after being switched off, the pinion 13 now has to be meshed by means of an axial pressure spring 25 in the still rotating ring gear 14 even before the internal combustion engine 15 is at a standstill and with the starter motor 11 not in use. The axial pressure spring 25 is arranged and axially prestressed here between the pinion 13 and the pinion shaft 26.

Figure 2:
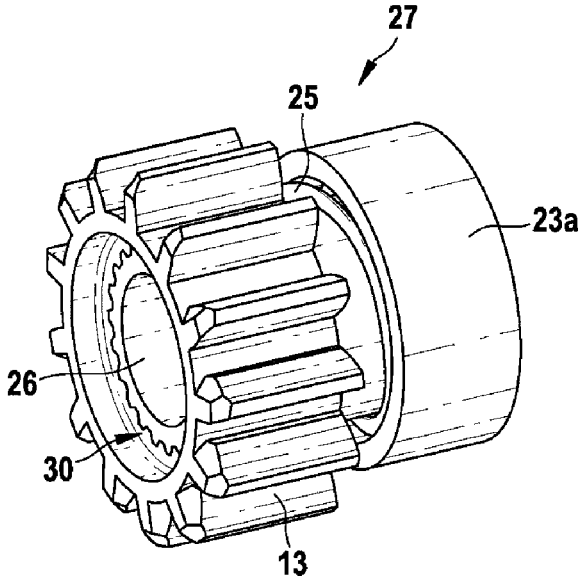
FIG. 2 shows the pinion, pinion shaft and free wheeling body of the starting device as a first exemplary embodiment in a three-dimensional illustration after assembly by means of a sliding toothing.

FIG. 2 shows, in a three-dimensional illustration, a constructional unit 27 consisting of the pinion 13, the axial pressure spring 25 and the pinion shaft 26 with a free wheel basic body 23*a*, wherein the pinion 13 is designed as a slip-on pinion.

Figure 3:
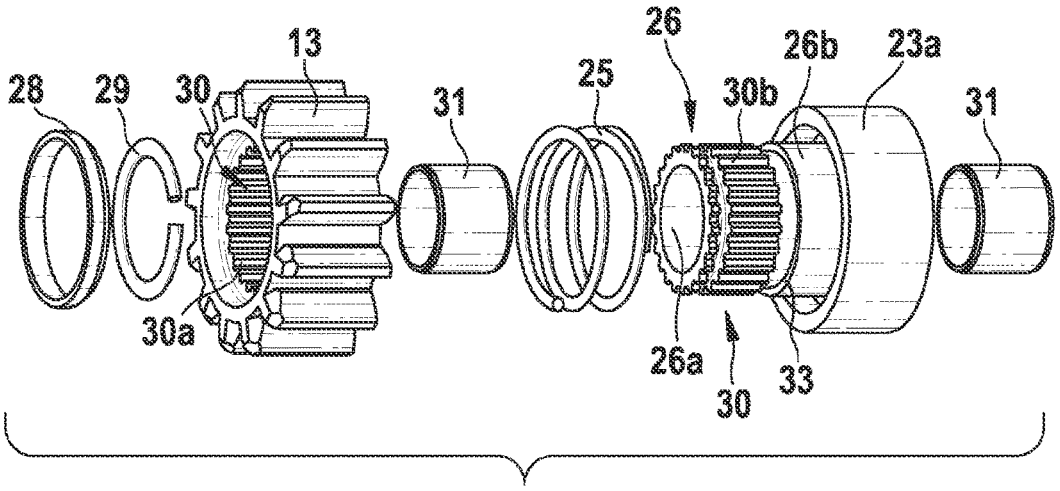
FIG. 3 shows the parts from FIG. 2 arranged in the manner of an explosion.

FIG. 3 shows said parts in an arrangement in the manner of an explosion, specifically a stop ring 28 as an axial stop for the pinion 13, a snap ring 29 for fixing the stop ring 28, the pinion 13 with a splined shaft internal bore 30*a*, with a bearing bushing 31, the axial pressure spring 25, the pinion shaft 26 with a splined shaft toothing 30*b* and the free wheel basic body 23*a*, and finally with a further bearing bushing 31. The pinion shaft 26, with its splined shaft toothing 30*b* together with the splined shaft internal bore 30*a* of the pinion 13, forms the axial sliding toothing 30 according to FIG. 2 for installing the pinion. The two bearing bushings 31 are inserted on both sides into a central bore 26*a* of the pinion shaft, in which the drive shaft 22 is accommodated when the starting device 10 from FIG. 1 is assembled. The axial pressure spring 25 is placed concentrically onto a thickened portion 26*b* which is arranged behind the splined shaft toothing 30*b* of the pinion shaft 26 and bears with the rear end thereof against an annular shoulder 33 of the pinion shaft 26. The front end of the axial pressure spring 25, which is in the form of a helical spring, bears against the rear side of the pinion.

Figure 4:
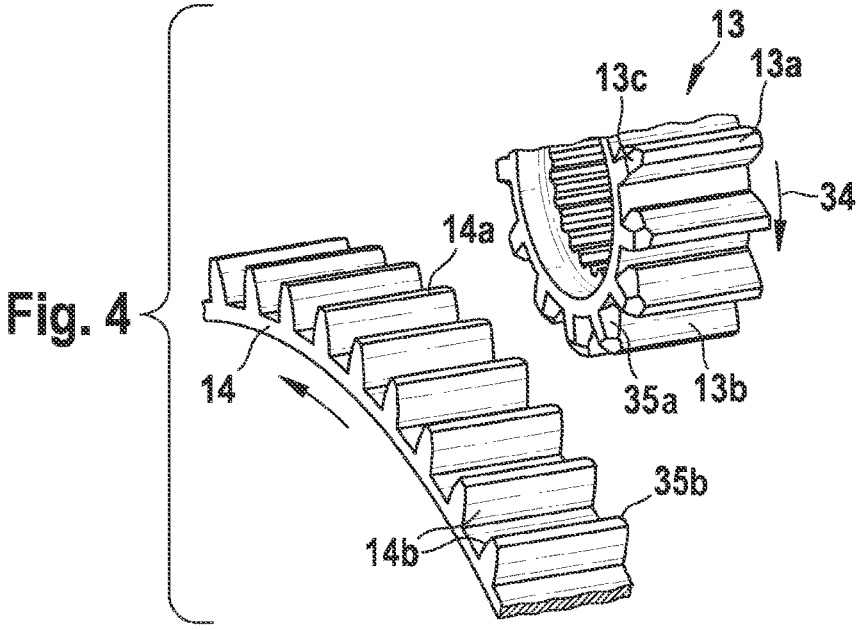
FIG. 4 shows an enlarged illustration of the toothing of the pinion and of the ring gear of the engine before meshing.

FIG. 4 is an enlarged illustration in three-dimensional form of a partial section of the pinion 13 of the starting device 10 from FIGS. 1 to 3 and of the ring gear 14, which is offset axially with respect to said pinion, of the internal combustion engine 15. It can be seen here that, when the pinion 13 is advanced axially to the engine ring gear 14, which is still rotating in the direction of the arrow, the pinion 13 is carried along in the direction of the arrow 34. In order to facilitate the engagement here of the pinion 13 in the ring gear 14 of the engine, the teeth 13*a* of the pinion 13 and teeth 14*a* of the ring gear 14 on the tooth end sides, which, in the demeshed state, are opposite and facing one another, are provided with beveled portions 35*a*, 35*b* of the respective tooth flanks 13*b* and 14*b*. The beveled portions 35*a*, 35*b* provided here on those tooth flanks 13*a*, 14*a* which enter into contact with each other upon meshing of the pinion 13 in the still rotating ring gear 14. In addition, the teeth 13*a* of the pinion 13 have a beveled end side 13*c* in the region of the tooth tip of said teeth, thus further facilitating the meshing operation. In this case, it could be sufficient, on the one hand, to provide the beveled portion 35*a* or 35*b* only on the teeth 14*b* of the ring gear 14 or on the teeth 13*a* of the pinion 13. On the other hand, it may be expedient to provide the beveled end sides 13*c* not only on the pinion 13 but also on the ring gear 14. The effect achieved by said measures individually or in combination is that, upon meshing in the still rotating ring gear 14 of the engine, the pinion 13 is either immediately carried along by the force of the pressure spring 25 and is then fully meshed, or the pinion 13 is first of all carried along by one of the teeth 14*a* of the ring gear 14 and that tooth 13*a* of the pinion 13 which comes into engagement with the ring gear 14 first of all once again slides off the beveled portions 35*a*, 35*b* of the tooth flanks 13*b*, 14*b* in order then, with slow rotation, already to engage to a further extent in the next tooth gap of the ring gear 14. The pinion shaft 26 is carried along in the process by the pinion 13, and the planetary gearing 21 and the starter motor 11 are decoupled via the free wheel 23.

In a development of the invention, before the engine 15 is at a standstill, the crank shaft is now rotated by means of the engine control unit 19 from the starter motor via the ring gear 14 into an optimum starting position for the subsequent restart.

Figure 5:
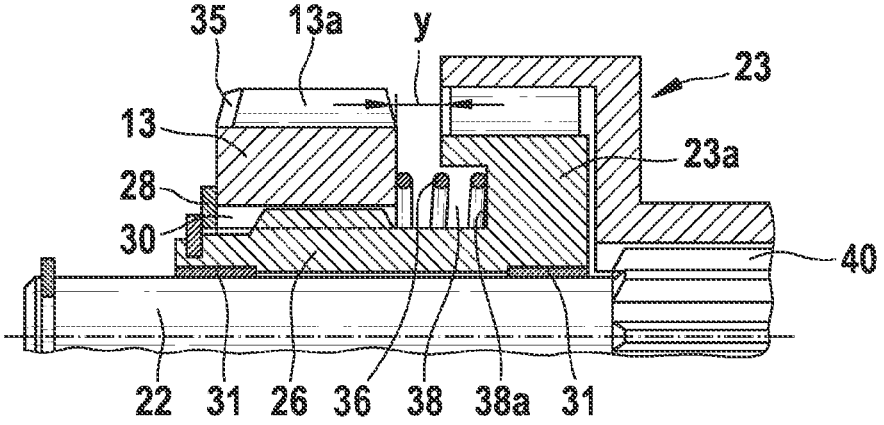
FIG. 5 shows the pinion, pinion shaft and free wheel in longitudinal section and an enlarged illustration.

FIG. 5 shows, on an enlarged scale, a longitudinal section of a modified embodiment of the invention, in which a helical spring 36 which is inserted behind the sliding toothing 30 between the pinion 13 and the pinion shaft 26 and is in the form of an axial pressure spring for the pinion 13 is partially accommodated in an annular recess 38 of the pinion shaft 26 in the region of the free wheel basic body 23*a*, and wherein the base 38*a* of the annular recess 38 forms the supporting surface for the rear end of the helical spring 36. In the inoperative state, the helical spring 36 presses the pinion 13 against the front stop ring 28, as a result of which y occurs in the axial spring travel between the rear side of the pinion 13 and the front end side of the free wheel basic body 23*a*, via which y the pinion 13 can be displaced axially on the sliding toothing 30 counter to the axial force of the prestressed helical spring 26. In this case, the axial resilience of the helical spring 36 is configured such that the resilience is softer than that of the engagement spring 24 of the starting device 10 according to FIG. 1. It is therefore possible for the beveled portions 35*a* on the front end side of the teeth 13*a* of the pinion 13 to slide off in a manner springing back resiliently with metered force during the operation to mesh the pinion 13 in the ring gear 14 of the engine 15. In addition, it is provided in this embodiment to design the "quick-acting screw thread", which is customary per se, between the free wheel and the drive shaft 22 of the starting device 10 as an axial sliding toothing 40 such that, for meshing the pinion, an undesirable rotation in the wrong direction is avoided.

Figure 6:
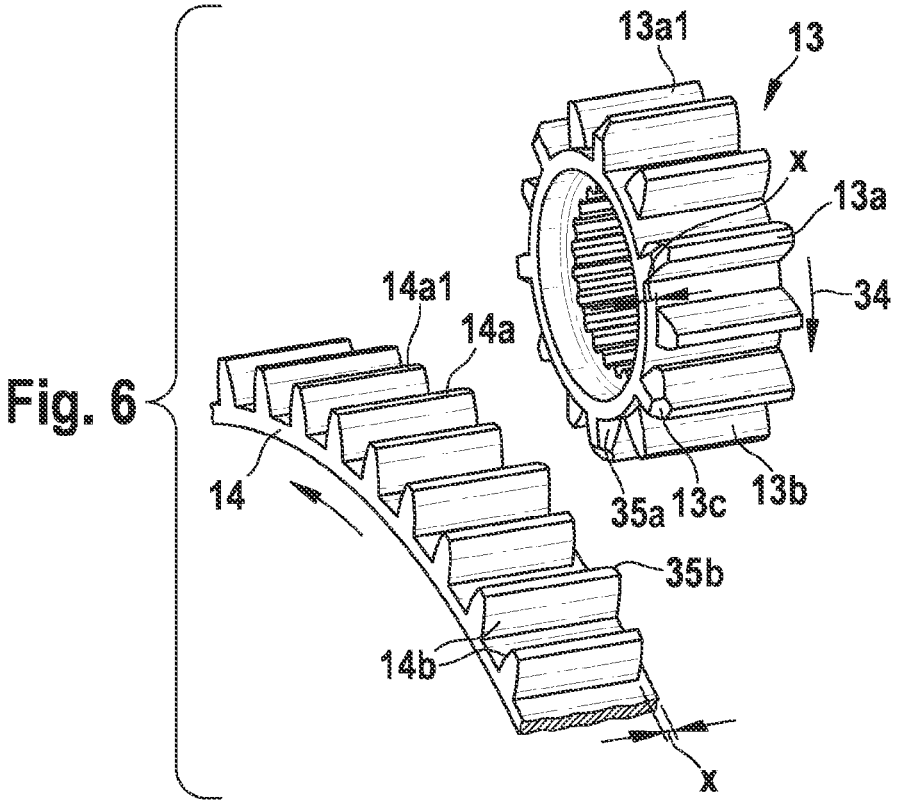
FIG. 6 shows a partial section of the ring gear and of the pinion with offset teeth in a three-dimensional, enlarged illustration as a second exemplary embodiment.

FIG. 6 shows a further exemplary embodiment of the invention, which relates to a particular design of the teeth of the pinion 13 and of the ring gear 14. For this purpose, FIG. 6 illustrates, in an enlarged, three-dimensional illustration, a partial section of the ring gear 14 of the internal combustion engine 15 from FIG. 1 and the pinion 13 of the starting device 10, in the demeshed state with respect to each other. The difference over the embodiment according to FIG. 5 is that the adjacent teeth 13*a* and 14*a* of the pinion 13 and of the ring gear 14 have an axial length which differs by the same amount in the region of those end edges which lie opposite one another. In this case, every second tooth 13*a*1 of the pinion 13 and every second tooth 14*a*1 of the ring gear 14 are shortened in relation to the pinion width and the ring gear width. In the same manner as in FIG. 4 in the first exemplary embodiment, the axially non-shortened teeth 13*a* and 14*a* of the pinion 13 and of the ring gear 14 have, on the front, opposite end sides thereof, a beveled portion 35 on the tooth flanks 13*b* and 14*b*. The beveled portion 35 is arranged on those tooth flanks 13*b* and 14*b* which are in contact with one another in the direction of rotation, which is illustrated by an arrow, of the still moving ring gear 14 upon meshing of the pinion 13. According to FIG. 6, these are the front tooth flanks 14*b* of the projecting teeth 14*a* of the ring gear 14 and those tooth flanks 13*b* of the projecting teeth 13*a* of the pinion 13 which are at the rear in the direction of rotation. Furthermore, the non-shortened teeth 13*a* and 14*a* of the pinion 13 and of the ring gear 14 have beveled front end sides which lie opposite in the demeshed state. In this case, it is sufficient for the end sides to be beveled only in the region 13*c* of the tooth tips.

In this exemplary embodiment, likewise at the beginning of a stop cycle of the internal combustion engine 15, the pinion 13 is first all moved forward to the ring gear 14 by the starter relay 12 via the engagement lever 20 after the internal combustion engine is switched off and before it is at a standstill and with the starter motor 11 not in use. Upon reaching a tooth-to-gap position, the pinion 13 is first of all engaged by a small amount in the ring gear 14 by means of the pressure spring 25. In the process, first of all two non-shortened teeth 13*a* and 14*a* of the pinion 13 and ring gear 14 come into contact by means of the beveled tooth flanks 13*b* and 14*b* thereof. The pinion 13 is first of all carried along only via a correspondingly small contact surface of the beveled portions 35*a* of the pinion tooth flanks 13*b* with the beveled portions 35*b* of the ring gear tooth flanks 14*b*. During slow rotation of the ring gear 14, the prestressing of the pressure spring 25 and the force of the engagement spring 24 of the starting device 10 are sufficient in order to carry along the low-mass pinion 13 and then to mesh the latter completely in the ring gear 14. In the process, the starting motor 11 and the gearing 21 of the starting device 10 are decoupled by the free wheel 23. By contrast, at a greater speed of rotation of the ring gear 14 and with pinions of larger mass, the pinion 13 is not immediately completely carried along by the ring gear 14 but rather slides in an axially resilient manner off via the beveled portion 35*a*, 35*b* of the unshortened teeth 13*a* and 14*a*, which are in contact with each other, by the pinion 13 being pressed axially out of the ring gear 14 again counter to the force of the pressure spring 25. Since the next non-shortened tooth 14*b* of the ring gear 14 is spaced apart by twice the tooth pitch from the preceding unshortened tooth, the pinion 13 now has available twice as much distance along the teeth in order to be able to engage to a greater extent in the ring gear 14 by means of the force of the pressure spring 25. In this position, the pinion is now completely carried along and is completely meshed in the ring gear 14 by means of the force of the engagement spring 24. It can therefore be ensured that, even with small advancing forces on the pinion 13, a toothing penetration depth sufficient for a long service life is achieved. When relatively low-mass slip-on pinions are used, the shortened teeth 13*a*1 and 14*a*1 and the advancing force of the engagement spring 24 cause the pinion 13 to be engaged in the ring gear 14 to a sufficient extent so as to be carried along immediately by the ring gear 14 without sliding off and springing back. Therefore, the pinion 13 slides off from and springs back axially onto the ring gear 14 only if there is a great difference in speed of rotation between the ring gear 14 and pinion 13.

The invention is not restricted to the embodiments illustrated and described but rather also comprises alternative solutions which can be adapted depending on the design of the starting device 10 from FIG. 1. It is thus also possible, within the context of the invention, to modify the sliding toothing between the pinion 13 and pinion shaft 26 such that the pinion 13, as a slip-on pinion for a "pointed mouth starter" is provided at the rear end with an outer toothing and the pinion shaft with the free wheel basic body is provided with an inner toothing. Since, at greater circumferential speeds of the ring gear, contact occurs only on the end initially sides between the teeth of the ring gear and of the pinion, the impact contacts which occur in this case cause energy to be exchanged between the pinion and ring gear such that the circumferential speeds are equalized. As soon as this has taken place fully, the pinion is advanced in a tooth-gap position into the ring gear to an extent such that it is no longer pressed out therefrom. In the case of a beveled contact surface, this means that the pinion is then advanced beyond the beveled portion into the ring gear and reaches a position in which the pinion can be fully engaged.

The invention claimed is:

1. A starting method for an internal combustion engine (15) in a motor vehicle, with an automatic start-stop system, a starter motor (11) of which drives a pinion (13) via a free wheel (23) to engage with a ring gear (14) of the internal combustion engine (15) in order to start the internal combustion engine (15), the method comprising:

at the beginning of a stop phase of the internal combustion engine (15) that is automatically initiated by the start-stop system, and while the ring gear (14) is still rotating after the internal combustion engine (15) is switched off and before the internal combustion engine (15) comes to a standstill, moving the pinion (13) axially by means of an engagement device (12, 20), through an axial pressure spring (25), to mesh in the ring gear (14) of the internal combustion engine (15);

engaging the pinion (13) with the still rotating ring gear (14) by means of the axial pressure spring (25) such that the pinion (13) is partially meshed with the still rotating ring gear (14) and carried along with the ring gear (14) only via correspondingly small contact surfaces (35*a*, 35*b*) of the tooth flanks (13*b*, 14*b*) of the pinion (13) and ring gear (14), the pinion (13) being pushed out of meshed engagement with the ring gear (14) at least once due to an excessive difference between the circumferential speed of the ring gear (14) and that of the pinion (13); and re-engaging the pinion (13) to a greater axial extent in the ring gear (14) before fully engaging the ring gear (14) when a reduced difference exists in the circumferential speeds of the pinion (13) and the ring gear (14).

2. The method as claimed in claim 1, further comprising rotating a crankshaft with the starter motor (11) as directed by an engine control unit (19) into an optimum starting position for the subsequent restart before the internal combustion engine (15) is at a standstill.

3. The method as claimed in claim 1, wherein the pinion (13) is a slip-on pinion.

4. The method as claimed in claim 1, wherein the pinion (13), at the beginning of the stop phase, is axially meshed in the ring gear (14) of the internal combustion engine by the engagement device (12, 20), with an interconnected engagement spring (24).

5. The method as claimed in claim 1, wherein at the beginning of the stop phase, the pinion (13) is meshed in the still rotating ring gear (14) by the axial pressure spring (25) after the internal combustion engine (15) is switched off and before the internal combustion engine (15) comes to a standstill, and with the starter motor (11) not in use.

6. A starting device having all of the features and elements set forth in claim 1 for carrying out the method as claimed in claim 1, in which the pinion (13) is displaceable axially on a pinion shaft (26) between two stops, characterized in that, for the axial cushioning of the pinion (13) upon meshing in the moving ring gear (14) of the internal combustion engine (15), the pressure spring (25) is arranged and is axially prestressed between the pinion (13) and the pinion shaft (26).

7. The starting device as claimed in claim 6, further comprising an engagement spring (24), and the pressure spring (25) has a smaller spring constant than the engagement spring (24).

8. The starting device as claimed in claim 6, characterized in that the pressure spring (25), in the form of a helical compression spring, is clamped between a rear side of the pinion (13) facing away from the ring gear (14) and an annular shoulder (33) of the pinion shaft (26) positioned adjacent a sliding toothing (30) of the pinion (13) and the pinion shaft (26).

9. The starting device as claimed in claim 6, characterized in that the teeth (13*a*, 14*a*) of one or both of the pinion (13) and of the ring gear (14) are provided on the axial end side thereof which faces the other of the pinion (13) and the ring gear (14) with a beveled portion (35*a*, 35*b*) of the tooth flanks (13*b*, 14*b*).

10. The starting device as claimed in claim 9, characterized in that the tooth flank (14*b*) of the ring gear (14) which is on a leading side in the direction of rotation of the ring gear (14) as rotated by operation of the internal combustion engine (15) is provided with a beveled portion (35*b*), and an additional beveled portion (35*a*) is provided on that tooth flank (13*b*) of the pinion (13) which is engageable by the leading side of the ring gear (14).

11. The starting device as claimed in claim 6, characterized in that the non-shortened teeth (13*a*, 14*a*) of the pinion (13) and/or of the ring gear (14) are beveled on the front end sides thereof, at least in a tooth tip region (13*c*).

12. The starting device as claimed in claim 6, characterized in that the pinion shaft (26) with the free wheel (23) arranged on a side remote from the ring gear (14) can be displaced axially on a drive shaft (22) via a sliding toothing (40) without a quick-acting screw thread.

13. A starting device having all of the features and elements set forth in claim 1 for carrying out the method as claimed in claim 1, with a pinion (13) which is displaceable axially on the pinion shaft (26) between two stops, characterized in that a tooth (13*a*) of the pinion (13) has an axial length which, on an axial end of the pinion (13) facing the ring gear (14), extends an amount (x) beyond an adjacent tooth (13*a*) on the pinion (13), and a tooth (14*a*) of the ring gear (14) has an axial length which, on an axial end of the ring gear (14) facing the pinion (13), extends the amount (x) beyond an adjacent tooth (14*a*) on the ring gear (14).

14. The starting device as claimed in claim 13, characterized in that the axially extended teeth (13*a*, 14*a*) of one or both of the pinion (13) and of the ring gear (14) are provided on the axial end side thereof which faces the other of the pinion (13) and the ring gear (14) with a beveled portion (35*a*, 35*b*) of the tooth flanks (13*b*, 14*b*).

15. The starting device as claimed in claim 14, characterized in that the tooth flank (14*b*) of the ring gear (14) which is on a leading side in the direction of rotation of the ring gear (14) as rotated by operation of the internal combustion engine (15) is provided with a beveled portion (35*b*), and an additional beveled portion (35*a*) is provided on that tooth flank (13*b*) of the pinion (13) which is engageable by the leading side of the ring gear (14).

16. The starting device as claimed in claim 15, characterized in that the axially extended teeth (13*a*, 14*a*) of the pinion (13) and/or of the ring gear (14) are additionally beveled in a tooth tip region (13*c*).

17. The starting device as claimed in claim 16, characterized in that the pinion shaft (26) with the free wheel (23) arranged on a side remote from the ring gear (14) can be displaced axially on a drive shaft (22) via a sliding toothing (40) without a quick-acting screw thread.

18. A starting device having all of the features and elements set forth in claim 1 for carrying out the method as claimed in claim 1, with a pinion (13) which is displaceable axially on the pinion shaft (26) between two stops, characterized in that every second tooth (13*a*) of the pinion (13) has an axial length which, on an axial end of the pinion (13) facing the ring gear (14), falls short of extending to the axial end of the pinion (13) by an amount (x), and every second tooth (14*a*) of the ring gear (14) has an axial length which, on an axial end of the ring gear (14) facing the pinion (13), falls short of extending to the axial end of the ring gear (14) by the amount (x).

* * * * *